US005129411A

United States Patent [19]

Lagerstrand

[11] Patent Number: 5,129,411

[45] Date of Patent: Jul. 14, 1992

[54] LIQUID LEVEL CONTROL ARRANGEMENT FOR A DISHWASHER

[75] Inventor: Dan E. Lagerstrand, Jönköping, Sweden

[73] Assignee: Aktiebolaget Electrolux, Stockholm, Sweden

[21] Appl. No.: 626,968

[22] Filed: Dec. 13, 1990

[30] Foreign Application Priority Data

Dec. 22, 1989 [SE] Sweden ..... 8904351

[51] Int. Cl.[5] ..... B08B 3/02

[52] U.S. Cl. ..... 134/56 D; 134/105; 134/111; 134/155; 134/186; 134/104.4

[58] Field of Search ..... 134/111, 155, 186, 105, 134/108, 104.4, 560, 90; 68/12.14, 12.15

[56] References Cited

U.S. PATENT DOCUMENTS

| | | | |
|---|---|---|---|
| 1,661,356 | 3/1928 | Baker | 134/111 |
| 2,083,012 | 6/1937 | Eastwood | 134/108 X |
| 2,674,249 | 4/1954 | Knight | 134/105 |
| 3,103,227 | 9/1963 | Long | 134/105 X |
| 4,277,290 | 7/1981 | Andrews et al. | 134/108 X |
| 4,833,900 | 5/1989 | Babuin et al. | 134/111 X |

FOREIGN PATENT DOCUMENTS

| | | | |
|---|---|---|---|
| 1181662 | 1/1985 | Canada | 134/56 D |
| 2408573 | 9/1975 | Fed. Rep. of Germany | 134/108 |

*Primary Examiner*—Frankie L. Stinson

*Attorney, Agent, or Firm*—Pearne, Gordon, McCoy & Granger

[57] ABSTRACT

A liquid level control arrangement for a dishwasher. The dishwasher comprises a tub (10) on which dishes are to be placed and in which liquid is to be circulated by means of a circulation pump (27). The circulation pump (27) communicates via a tube-shaped connection (26) with an inlet (25) which is placed in the lower part of a chamber (23) situated at the bottom of the tub. The chamber is at least partly separated from the tub by means of a filter (20) or the like, and also comprises a heating source (31) for warming the liquid. The connection (26), in addition to said inlet (25), has an opening (32) which at least partly is placed above or at the same level as the heat-emitting parts of the heating source (31). The opening (32) has a shape and size such that the surface thereof exposed to the chamber increases when the liquid level in the chamber sinks.

4 Claims, 2 Drawing Sheets

LIQUID LEVEL CONTROL ARRANGEMENT FOR A DISHWASHER

BACKGROUND OF THE INVENTION

The present invention relates in general to dishwashers, and more particularly to means to maintain the proper liquid level in a dishwasher.

DESCRIPTION OF RELATED ART

Commonly, a dishwasher comprises a tub in which dishes are placed and in which liquid is circulated by means of a circulation pump. The circulation pump communicates via a tube-shaped or otherwise-shaped connection with an inlet which is placed in the lower part of a chamber situated at the bottom of the tub. The chamber may be at least partly separated from the tub by means of a filter or the like. The chamber may also comprise a heating source for warming the liquid. As more fully described in German Patent No. DE 2,412,257, the connection, in addition to the inlet, may also have an opening which at least partly is placed above or at the same level as the heat-emitting parts of the heating source.

The purpose of this arrangement, which is described in De 2,412,257, is to prevent the liquid surface from sinking to an unacceptable level. If the liquid surface sinks below the heating source, this means that the heating source, and perhaps also the bottom of the chamber, will no longer be covered by cooling liquid. This will result in overheating of the heating source and also in deformation of the bottom when the bottom is made of plastic. By providing the inlet channel of the pump with an air inlet which is placed at a horizontal level higher than the heating source, a sudden airflow into the pump will occur when the flow of liquid to the chamber has been reduced, i.e., when the filter has been clogged. This means that the pressure will drop rapidly and activate a pressure sensor, which will disconnect the heating source. This arrangement has the drawback that the heating process is cut off, leading to a poor dishwashing result.

SUMMARY OF THE INVENTION

The purpose of the present invention is to eliminate the above-mentioned drawback. In accordance with the present invention, a dishwasher comprising a tub (10) in which dishes are to be placed and in which liquid is to be circulated by means of a circulation pump (27) is disclosed. The circulation pump communicates via a tube-shaped connection (26) with an inlet (25) which is placed in the lower part of a chamber (23) situated at the bottom of the tub. The chamber is at least partly separated from the tub by means of a filter (20) or the like. The chamber also comprises a heating source (31) for warming the liquid. The connection (26), in addition to the inlet (25), has an opening (32) which at least partly is placed above or at the same level as the heat-emitting parts of the heating source. The opening (32) is of such a shape and size that the surface thereof exposed to the chamber increases when the liquid level in the chamber sinks.

The purpose of the present invention is to create an arrangement where the liquid level, and hence the spray pressure, are controlled with respect to the degree of filter clogging. At the same time, the electric supply to the heating source is maintained so that the dishwashing procedure can be completed.

A preferred embodiment of the present invention is described in the following specification with reference to the accompanying drawings.

DESCRIPTION OF THE PREFERRED EMBODIMENT

Figure 1:
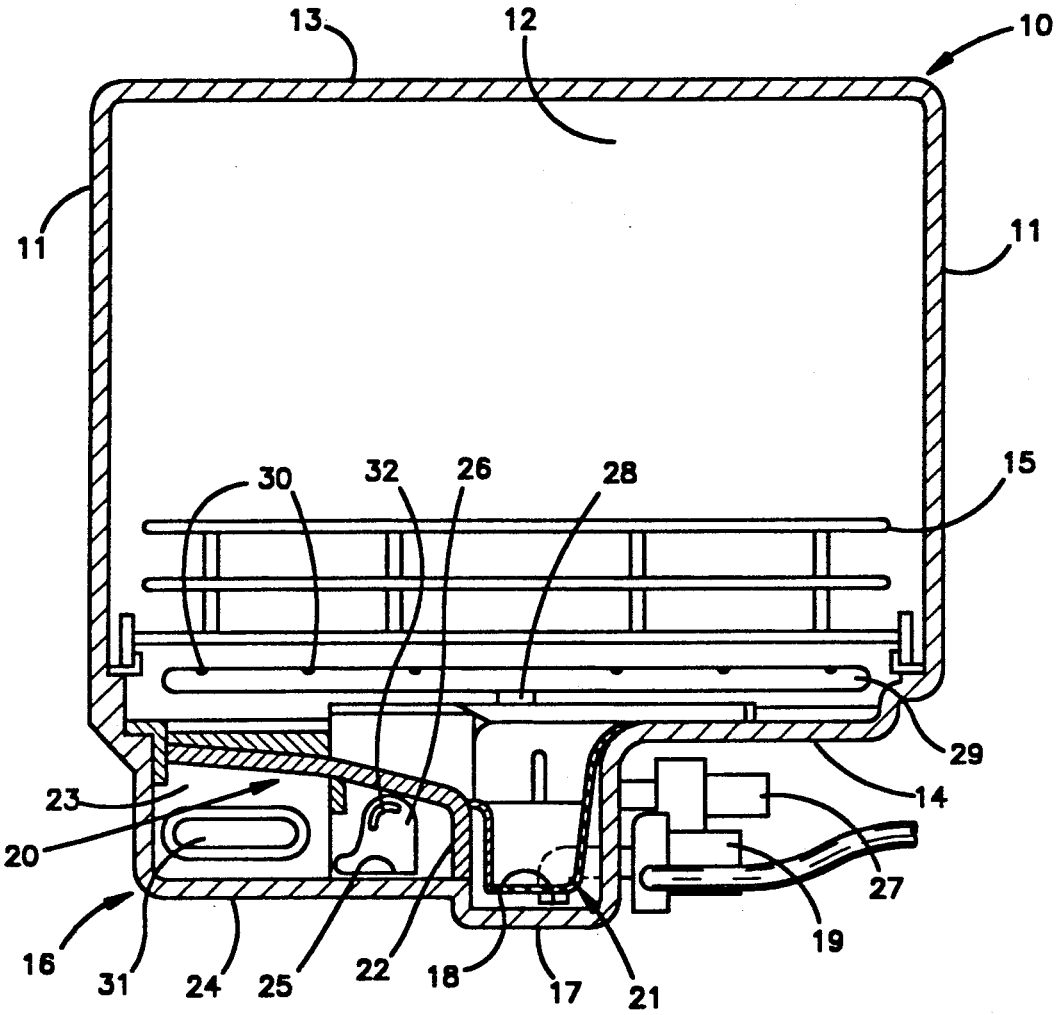
FIG. 1 shows a vertical section through a dishwasher according to the present invention.
Figure 3:
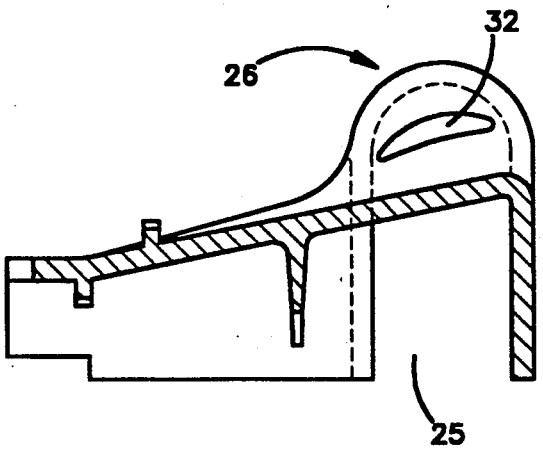
FIG. 3 shows a vertical section through the portion of the tube in the vicinity of element 32.
Figure 2:
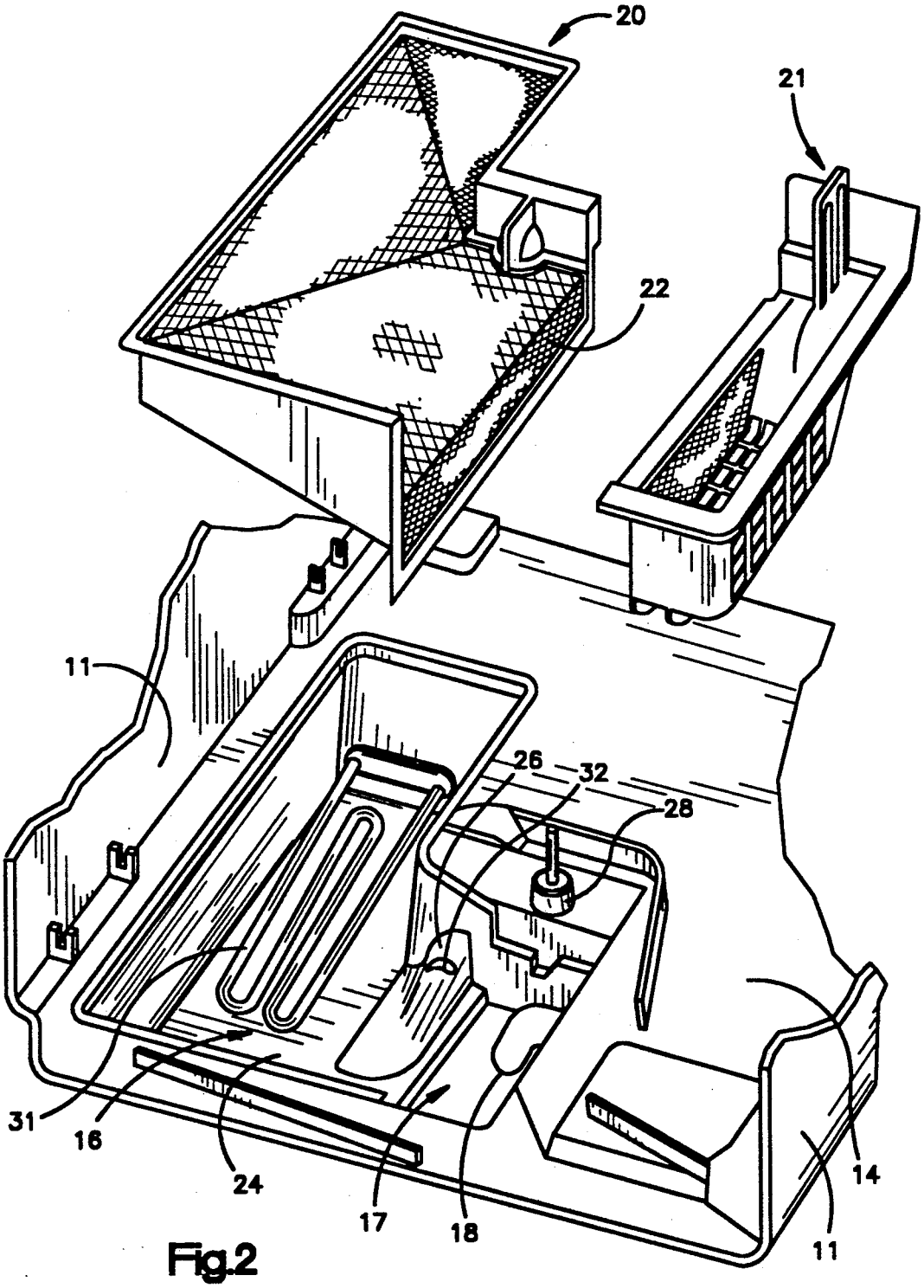
FIG. 2 shows in an exploded view the lower part of the tub of the present invention.

With reference to FIGS. 1, 2, and 3, there is shown a dishwasher which comprises a tub having side walls 11, a rear wall 12, a roof part 13, and a bottom 14. Moreover, there is a door (not shown) which normally covers the front wall. One or several baskets 15 for holding dishes can be inserted into the tub. The bottom of the dishwasher is inclined downwards to a collecting container 16. Part of the container 16 forms a sump 17 in which the inlet 18 to a drain pump 19 is placed.

The container 16 is covered by a fine sieve 20 and a coarse sieve 21, both of which can be lifted from the container 16 for cleaning. The fine sieve 20 covers the upper part of the container 16 and also forms a partition wall 22 in the container 16 so that a chamber 23 is created. This chamber 23 communicates, via an inlet opening 25 adjacent the bottom of the chamber and a tube-shaped connection 26, with the suction side of a circulation pump 27. The circulation pump 27 has an outlet connected to a pipe 28 which is centrally placed in the dishwasher and on which a spray arm 29 with nozzles 30 is placed for rotating motion. The chamber 23 also encloses a heating source 31 in the form of an electric coil or the like extending horizontally from one of the walls of the chamber 23.

The connection 26, the lower part of which is provided with the downwardly extending, comparatively large inlet opening 25 and the upper end of which communicates with the circulation pump 27, has a slot-shaped, curved opening 32 which faces towards the chamber 23 and which at least partly is placed above or at the same level as the upper heat-emitting part of the heating source 31, which means that the surface of the opening 32 exposed to the chamber above the liquid level increases when the liquid level sinks.

The arrangement operates in the following way. During the circulation cycle, the liquid flowing out from the nozzles 30 is collected at the bottom of the tub and is directed towards the container 16 and flows through and on the fine sieve 20 and the coarse sieve 21 into the chamber 23, from which the liquid is sucked out by means of the circulation pump 27 and is delivered to the rotating spray arm 29. During the dishwashing cycle, the liquid level in the chamber 23 is normally situated above the heating source. Should, however, the fine sieve 20 become so clogged that the liquid level in the chamber 23 sinks because the capacity of the circulation pump 27 exceeds the incoming flow, the opening 32 will successively be uncovered. This means that the circulation pump will suck more and more air and gradually reduce the flow of water through said pump, resulting in a balanced water level. Thus, a simple, self-controlled flow through the pump is achieved at the same time that the electric supply to the heating source is maintained. This means that the dishwashing cycle is completed, although with reduced spray pressure. Usually, the filter is cleaned during such a process, since the hot water dissolves the particles which are clogged in the filter.

It should be observed that when the water surface reaches a predetermined minimum level corresponding to the level of the heating source, which would be the case if the filter were totally blocked, the electric supply to the heating source has to be cut off. This can be easily effected by setting the pressure sensing means in the circulation circuit for the water at such a value that the electric supply to the heating source is disconnected when this pressure drops too much.

Although the preferred embodiment of this invention has been shown and described, it should be understood that various modifications, replacements, and rearrangements of the parts may be resorted to without departing from the scope of the invention as described and claimed herein.

What is claimed is:

1. A dishwasher comprising a tub (10) in which dishes are to be placed and in which liquid is to be circulated by means of a circulation pump (27) which communicates via a tube-shaped connection (26) with an inlet (25) which is placed in the lower part of a chamber (23) situated at the bottom of said tub, said chamber at least partly being separated from said tub by means of a filter (20), said chamber also comprising a heating source (31) for warming the liquid, said connection (26) in addition to said inlet (25) having an opening (32) which at least partly is placed above or at the same level as the heat-emitting parts of said heating source, wherein said opening (32) has a shape and size such that the surface thereof exposed to said chamber increases when the liquid level in said chamber sinks such that the pump will suck more air and gradually reduce the flow of water through said pump.

2. A dishwasher according to claim 1, wherein said connection (26) extends upwards to said pump (27) from the lower part of said chamber (23).

3. A dishwasher according to claim 2, wherein said opening (32) is slot-shaped.

4. A dishwasher according to claim 1, wherein said opening (32) is slot-shaped.

* * * * *